US006142130A

United States Patent [19]

Ward

[11] Patent Number: 6,142,130

[45] Date of Patent: Nov. 7, 2000

[54] LOW INDUCTANCE HIGH ENERGY INDUCTIVE IGNITION SYSTEM

[76] Inventor: Michael A. V. Ward, 32 Prentiss Rd., Lexington, Mass. 02476

[21] Appl. No.: 09/284,810

[22] PCT Filed: Dec. 12, 1996

[86] PCT No.: PCT/US96/19898

§ 371 Date: Apr. 21, 1999

§ 102(e) Date: Apr. 21, 1999

[87] PCT Pub. No.: WO97/21920

PCT Pub. Date: Jun. 19, 1997

Related U.S. Application Data

[60] Provisional application No. 60/008,599, Dec. 13, 1995, provisional application No. 60/011,739, Feb. 15, 1996, and provisional application No. 60/029,145, Oct. 21, 1996.

[51] Int. Cl.[7] ..... F02P 3/05

[52] U.S. Cl. ..... 123/606; 123/620; 123/634; 361/263

[58] Field of Search ..... 123/598, 605, 123/606, 609, 620, 634, 637, 643, 644; 361/263

[56] References Cited

U.S. PATENT DOCUMENTS

| | | | |
|---|---|---|---|
| 4,522,185 | 6/1985 | Nguyen | 123/637 |
| 5,056,497 | 10/1991 | Akagi et al. | 123/609 |
| 5,193,514 | 3/1993 | Kobayashi et al. | 123/634 |
| 5,315,982 | 5/1994 | Ward et al. | 123/634 |
| 5,558,071 | 9/1996 | Ward et al. | 123/598 |

*Primary Examiner*—Andrew M. Dolinar
*Attorney, Agent, or Firm*—Perkins, Smith&Cohen, LLP; Jerry Cohen

[57] ABSTRACT

A high power, high energy inductive ignition system with a parallel array of multiple ignition coils Ti (2*a*, 2*b*) and associated 600 volt unclamped IGBT power switches Si (8*a*, 8*b*), for use with an automotive 12 volt storage battery (1), the system having an internal voltage source (12) to generate a voltage Vc approximately three times the peal primary coil current with coils Ti of low primary inductance of about 0,5 millihenry and of open E-type core structure for spark energy in the range of 120 to 250 mj, the system using a lossless snubber and variable control inductor (6) to provide very high circuit and component efficiency and high coil energy density, in mj/gm, three times that of conventional inductive ignition systems, and high output voltage of 40 kilovolts with fast rise time of 10 microseconds.

82 Claims, 3 Drawing Sheets

LOW INDUCTANCE HIGH ENERGY INDUCTIVE IGNITION SYSTEM

This application claims priority under 35 U.S.C. 119(e) of provisional applications Ser. No. 60/008,599, filed Dec. 13, 1995; Ser. No. 60/011,739, filed Feb. 15, 1996; and Ser. No. 60/029,145, filed Oct. 21, 1996.

BACKGROUND OF THE INVENTION AND PRIOR ART

There is a move in the automotive industry to distributorless ignition systems of one coil per spark plug, and particularly towards plug-mounted coils. Motivations for this are more compact ignition, elimination of electromagnetic interference, and higher ignition efficiency (no distributor or spark plug wires), as well as other reasons.

There is also a desire to maintain and even raise, the spark plug energy that is delivered to the combustible mixture for ignition. While energy delivery efficiency of plug-mounted coils increases due to elimination of the distributor and spark plug wires, the constraints on the coil size reduce the energy that can be stored in the core and delivered to the spark gap. The coil winding resistance increases as the coil diameter is reduced in inverse relationship to the fourth power of the diameter, to make the coil ever less efficient as it is made smaller. The high coil primary inductance Lp of 2 to 8 milliHenry (mH), and low peak primary current Ipo of typically 4 to 10 amps available from a car battery of voltage Vb (of 6 to 13 volts), limit the energy that can be stored and delivered to the spark gap and limit the magnitude and quality of the spark that is delivered (50 milliamps typical spark current).

There is a need for an improved ignition with coils that are compact, light weight, inexpensive, and simple to fabricate and are suitable for plug mounting (or locating near the plug) which can store high energy of 150 to 600 millijoules (mj) and deliver high spark energy of 120 to 500 mj with high energy delivery efficiency. There is also a need to improve the overall operation of the inductive ignition system to permit higher switch break currents and higher stored energy while placing less stress on the coil's magnetic core and power switch.

SUMMARY OF THE INVENTION

In this patent application is disclosed a high power, high energy, high efficiency inductive ignition system in which the operating supply voltage Vc energizing the ignition coils is made independent of the variable, low voltage, battery supply voltage Vb (or other voltage of other ignition systems), and the operating voltage Vc is selected in conjunction with low inductance compact ignition coils suitable for plug mountain, or for other type of mounting near the spark plug, to provide higher ignition energy and higher operating efficiency than the conventional automotive Kettering inductive ignition system.

The ignition system disclosed is designated as "Hybrid Inductive Ignition", or HBI, since it features inductive energy storage in the magnetic core of the ignition coil as in the conventional inductive system, but also features energy storage at a higher and approximately constant voltage Vc, typically on an energy storage electrolytic capacitor, for delivery to the magnetic core of the ignition coil. For the low battery voltage Vb automotive application, the system features a high efficiency, e.g. 90%, DC to DC power converter with isolation, and other system features mentioned below and disclosed in the description.

The ignition system is designed to more optimally operate by having the supply voltage set at about three time the standard automotive battery voltage of 14 volts, i.e. with Vc approximately 42 volts, and the peak "break" or coil primary winding switching current Ipo at about three times the maximum of 10 amps used in conventional systems, i.e. with Ipo approximately 30 amps. The coil primary inductance Lp is then selected to be in the range of 0.2 to 1.0 milliHenry (mH), an order of magnitude less than that of the standard inductive system but such that approximately three times the energy Epo can be stored in the coil's magnetic core and approximately three times the "useful" energy Eso can be delivered to the spark as required for best engine dilution tolerance.

To obtain the required system features and achieve the required results, the ignition features open core structure with relatively confined magnetic fields for low primary inductance Lp and low cost manufacture. The core can be open E-type, open cylindrical type as in a pencil coil, or other open type core, including 1-core structure to provide suitably low primary inductance Lp in the range of 0.2 mH and 1 mH for spark energies in the range of 120 to 600 mj. A closed core structure with a large air gap, or biasing magnet, can also be used. Other features of the ignition is the use of a variable (or saturating) control inductor of inductance Lsat to reduce the peak coil secondary voltage on switch closure to approximately one half normal where variable inductance Lsat ideally varies between approximately 60% of the coil primary inductance Lp at low primary currents Ip to less than one tenth its initial value at the break current Ipo to store less than 10% of the coil energy (preferably about 5%). The ignition also features use of a lossless snubber in conjunction with the use of preferably internally unclamped 600 volt Insulated Gate Bipolar Transistors (IGBTs) to store and deliver back to the power supply most of the energy associated with the coil primary leakage inductance Lpe and variable inductance Lsat occurring at the time of the coil power switch opening with peak break current Ipo.

By the very nature of the ignition, the ignition spark is of higher peak current, typically in the range 300 to 500 milliamps (ma), representing an initial arc type spark discharge which decays to a glow discharge. The low current arc discharge is more efficient in delivering spark energy to the mixture in the gap (versus to the electrodes) and is less, susceptible to being blown out, or segmented, under higher mixture flow velocities as is found in high efficiency modem engines. Other features of the system is the use of particular simple form of current sensing circuit, power switch driver circuit, input triggering circuits, and other features described below in further detail and in the disclosure.

More generally, the ignition system is usable with both batteries and other forms of voltage sources and applies to both internal and external combustion engines. For the present automotive application, i.e. cars, trucks, busses, marine engines, etc., the power unit uses a DC-DC power converter, preferably fly-back. The power unit generates the higher voltage Vc (about three times conventional) and provides the required high current Ipo of about 30 amps with minimum coil and switch dissipation over a wide range of battery input voltages, including 5 volts. As already mentioned, it operates with a simplified form of current sensing for coil energizing by current charging, with variable control inductor (VCI), and with lossless snubber circuit to return most of the energy stored in the VCI and coil leakage inductance, after ignition coil switch opening, to the power supply. Preferably, it provides high spark energy dictated by a new "proportional volume ignition criterion" disclosed herein, and can even provide multiple spark firing with high duty cycle by inclusion of a diode in the coil secondary, if desired.

For the coil primary winding, 40 to 80 turns Np of wire are used (and around 100 for pencil coils) in a two layer winding of turns ratio N of 50 to 100, more preferably 60 to 80, where N=Ns/Np, and Ns is the number of secondary turns. The power switch S for controlling the primary current is preferably a 400 to 900 volt IGBT, more preferably a standard 600 volt unclamped IGBT with current capability of 30 to 60 amps. The magnetic core of the coil is open E-type or open cylindrical type for pencil coils. For the open E-type preferably the material used is laminated 9 to 24 mil SiFe, preferably standard 14 mil oriented (M6). For the pencil coil, preferable the center cylindrical core on which is wound the primary winding is made up of laminations of different widths to give a high fill, with preferably a small center gap of about 1 mm, or bunched round or hexagon wire, or cylinder of powder iron preferably with a gap in the middle which can contain a biasing magnet to increase the maximum magnetic flux swing to offset the more limited capability of the powder iron material.

In more general terms, the invent on comprises a high efficiency, high power, high energy inductive ignition system with power unit and controller that, in comparison to conventional inductive ignition systems, (a) provides a higher voltage Vc of 24 to 80 volts used for rapidly charging the primary winding of a coil with low inductance primary Lp of 0.2 to 1.0 ml to a current of about 20 to 50 amps without false firing upon switch closure; (b) advantageously, as a result of the low inductance Lp, uses simpler open core type coils with moderately confined magnetic fields; and (c) uses simpler control circuits of only one current sensor and one switch controlling device or power switch driver for multi-coil, multi-power switch applications. The new system uses a low loss snubber circuit associated with the power switches Si, including an input trigger disabling circuit based on the snubber circuit, with coil power switches Si and coils operating with much less heating than conventional inductive ignition systems for a given stored energy because of the lower primary inductance and short dwell time Tdw (time required to energize the magnetic core of the coil). The low primary inductance Lp and low :urns ratio N (of approximately 75 from use with the preferable 600 volt IGBT) result in low coil secondary inductance Ls and faster high voltage rise time Trise of 5 to 20 microseconds to provide much greater resistance to plug fouling than the conventional inductive ignition.

Overall ignition system efficiency of the new system is 50% and higher, i.e. ratio of spark energy to energy drawn from the battery, as a result of the high DC-DC power converter efficiency (typically 90%), low primary circuit resistance (typically about 0.2 ohms), low secondary winding resistance Rs, typically about 500 ohms, and the lossless nature of the snubber. For coil core stored energy El of 150 to 600 mj, depending on coil type and application, approximately 70% to 85% of the stored energy is delivered into an 800 volt zener load, the industry standard load, or a total "standard spark energy" above 100 mj at a high power level of typically 40 to 200 watts.

To understand an engine's ignition energy requirements reference is made to test engine ignition measurements made by Robert Bosch and General Motors in the 1970's. They showed that for peak spark currents of 100 ma, the minimum spark energy required for best engine dilution tolerance, i.e. best engine efficiency and emissions is 120 mj in one case and 250 mj in the other case. Translated to the industry standard of an 800 volt zener load, 120 mj to 250 mj spark energy translates to a "standard spark energy", SSPE, of 150 mj to 300 mj for a (glow discharge) likely spark voltage of 650 volts (or 80% of 800 volts). SSPE shall be used henceforth to mean the energy measured with the industry standard 800 volt zener load, and the criterion for minimum required spark energy for best engine dilution tolerance disclosed herein shall be referenced to an 800 volt zener load, recognizing the SSPE is approximately proportional to the "effective spark energy", ESPE, where ESPE is the energy delivered to the mixture in the spark gap in the form of a high temperature plasma versus that delivered to the electrodes, i.e. measured by subtracting out the electrode drops.

From experimental ignition bench test measurements of a 1.25 mm spark gap it is found that a low current glow discharge spark (50 to 100 ma) provides about 80% spark energy relative to the "standard spark energy". However, since only approximately 30% of the spark energy is effective (70% of the spark voltage being dropped at the electrode), the ESPE is approximately 24% of the SSPE. On the other hand, while the preferred arc discharge is found to provide only 50% spark energy relative to SSPE (because of its lower electrode drop), approximately 50% of the spark energy is effective, for ESPE of approximately 24% of the SSE, equal to that of the low current glow discharge, verifying the usefulness of the SSPE as a proportionality criterion for measuring spark effectiveness (ESPE) for the glow and low current arc. On the other hand, the SSPE is not useful for spark duration, giving values approximately 80% and 33% for the glow and arc discharge respectively.

Hence, the ignition criterion disclosed herein can use SSPE for defining the required spark energy for best dilution tolerance. The criterion states that for a given engine, the required SSPE is on that ignites a constant fraction of the mixture volume assuming the mixture flows through the spark gap in proportion to the piston speed. This novel "proportional volume ignition criterion", PVIC, shows that for typical engines, ignition SSPE of 150 mj to 300 mj is required, or 180 mj to 360 mj stored energy for a well designed system, and higher SSPE is required for large bore slow speed engines. Such high SSPE for compact ignition coils of preferred volume of 30 to 60 cc (cubic centimeters), approximately 30 cc for 150 mj pencil coils, approximately 40 cc for 200 mj block coils, and approximately 60 cc for 300 mj cylindrical coils, are achievable with the hybrid inductive ignition (HBI disclosed herein and are impractical for conventional ignition. The present invention includes HBI ignition systems using effective combinations of ESPE and PVIC, and engines including such ignition systems.

A preferred HBI automotive ignition system design has the following approximate values of parameters: supply voltage (Vc) 40 volts, peak current (Ipo) 30 amps, primary inductance (Lp) 0.5 mH, standard spark energy 200 mj, peak output voltage 40 kV, switch (IGBT) voltage 600 volts, turns ratio (N) 75, and peak spark current Is 400 ma. The snubber capacitor is preferably 600 volt, 0.2 to 0.4 microfarads (uF) capacitor which charges up to approximately 450 volts when the coil power switches open, and the snubber inductor is preferably in the one to ten millihenry range.

The term "approximately" as used herein means within ±25% of the term it qualifies, and the term "about" means between ½ and 2 times the term it qualifies. The term "equal to" generally means within ±10%, and the term "exactly equal to" shall be taken to mean within ±5%.

OBJECTS OF THE INVENTION

The principal object of the present invention is to provide an inductive type of ignition system which employs higher energy density coils that are compact, low cost, and suitable for spark plug mounting or placement near the spark plug, which have a much higher stored and delivered spark energy than the conventional Kettering inductive ignition coils, delivering 150 to 500 mj "standard spark energy" to improve engine dilution tolerance, the spark energy delivery being in the form of a higher spark current of 100's of milliamps which is resistant to spark segmentation by high flow.

A related object is to provide compact, lower cost coils that advantageously use their lower primary inductance by being made up of simple open E-core structures which have nonetheless relatively confined magnetic fields.

A further object is to accomplish this with the disclosed higher operating input voltage Vc of approximately three times that of standard 13 volt battery and higher peak break current Ipo of 20 to 50 amps (at least three times standard current) over a wide range of battery voltages, including 5 volts, with minimum number of additional components and at a high efficiency, achievable in the case of present automotive ignitions where higher stable voltage Vc is not currently available, typically by use of a DC-DC fly-back converter, or boost converter if isolation between the battery and switch is not required. If higher voltages, e.g. 24 volts or 40 volt supply, are available, this object becomes limited to providing rapid, essentially dwell-free charging of the primary inductances of the low inductance (about 0.5 mH) coils or higher coil stored energy, higher spark power, and higher switch efficiency, with a low loss snubber circuit employed to store the energy in an optional preferred variable inductor and coil leakage inductance (upon switch opening) to deliver that energy back to the power supply to maximize circuit efficiency and minimize heating of the power unit containing the power converter, variable control inductor, and other components.

Another object is to simplify the ignition control circuitry by using one instead of four current sensing circuits (for four power switches for an assumed 4-cylinder engine with one coil and one switch per spark plug). This includes use of a simplified power switch driver circuit having only one active switch driver transistor component for a multi-cylinder engine with multiple coils and power switches Si, and using a comparator to provide the power switch dwell-time, shut-off, and protection override, and including an input trigger disabling circuit which uses the voltage level of the snubber capacitor (which is charged upon switch opening) to disable the input for a set period of time to prevent false firing, or to use the disable time to achieve multi-firing for a period dictated by a long duration input trigger.

Another object is to use the advantages provided by the HBI ignition, which stores capacitive energy at a higher voltage Vc than battery voltage, to store more than the energy required for one spark firing to enable delivery of more than one spark firing pulse during cold start and during engine cold running without substantial voltage droop, or to use a diode means on the coil secondary to allow recharging of the coil during spark firing to provide a high duty cycle, e.g. above 80%, firing of a train of more than one inductive spark.

Another object is to use a pencil coil with center core made up of two cylindrical sections separated by an air rap which lowers the primary inductance and provides improved performance for a laminated core, and which for powder iron cores allows for a biasing magnet to be placed in the gap to raise the core's energy storage capability. The ends of pencil coil may be open, and the outer shield made up of wrapped thin magnetic sheet, or one turn of magnetic sheet designed to have a skin depth approximately equal to the sheet thickness.

Another object is to use the new "proportional volume ignition criterion", or PVIC, to define the high, minimum required spark energy and to provide the energy by means of the HBI system described herein.

Another object is to design a compact, low cost power unit (box) which includes all the HBI components other than the ignition coils, i.e. the power converter, higher voltage Vc power supply and variable inductor, ignition power switches and switch driver, lossless snubber, and ignition controller, and in particular to insure that the three magnetic components included in the power unit have the minimum weight, size, and cost, and the maximum efficiency and effectiveness, i.e. the DC-DC power converter transformer made up of a ferrite core with narrow winding window, the variable control inductor made up of a very small, low cost powder iron core of high initial permeability, and the snubber inductor which preferably has a narrow winding window and is made of special design, low cost powder iron with high energy storage.

Other features and objects of the invention will be apparent from the following detailed drawings of preferred embodiments of the present invention taken in conjunction with the accompanying drawings, in which:

DESCRIPTION OF PREFERRED EMBODIMENTS

Figure 1:
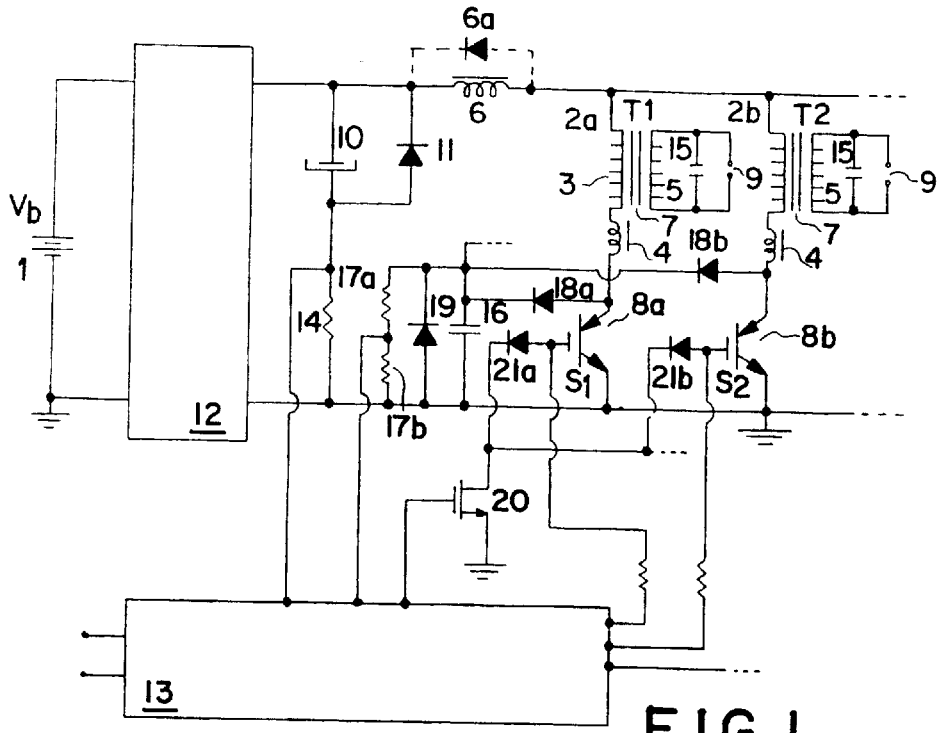
FIG. 1 is a partial block diagram, partial circuit diagram of an embodiment of the Hybrid Inductive Ignition, or HBI, system showing two of several coils and power switches, variable control inductor, simple dissipative snubber, preferred driver circuit, and power converter and ignition controller in block forms.
Figure 10:
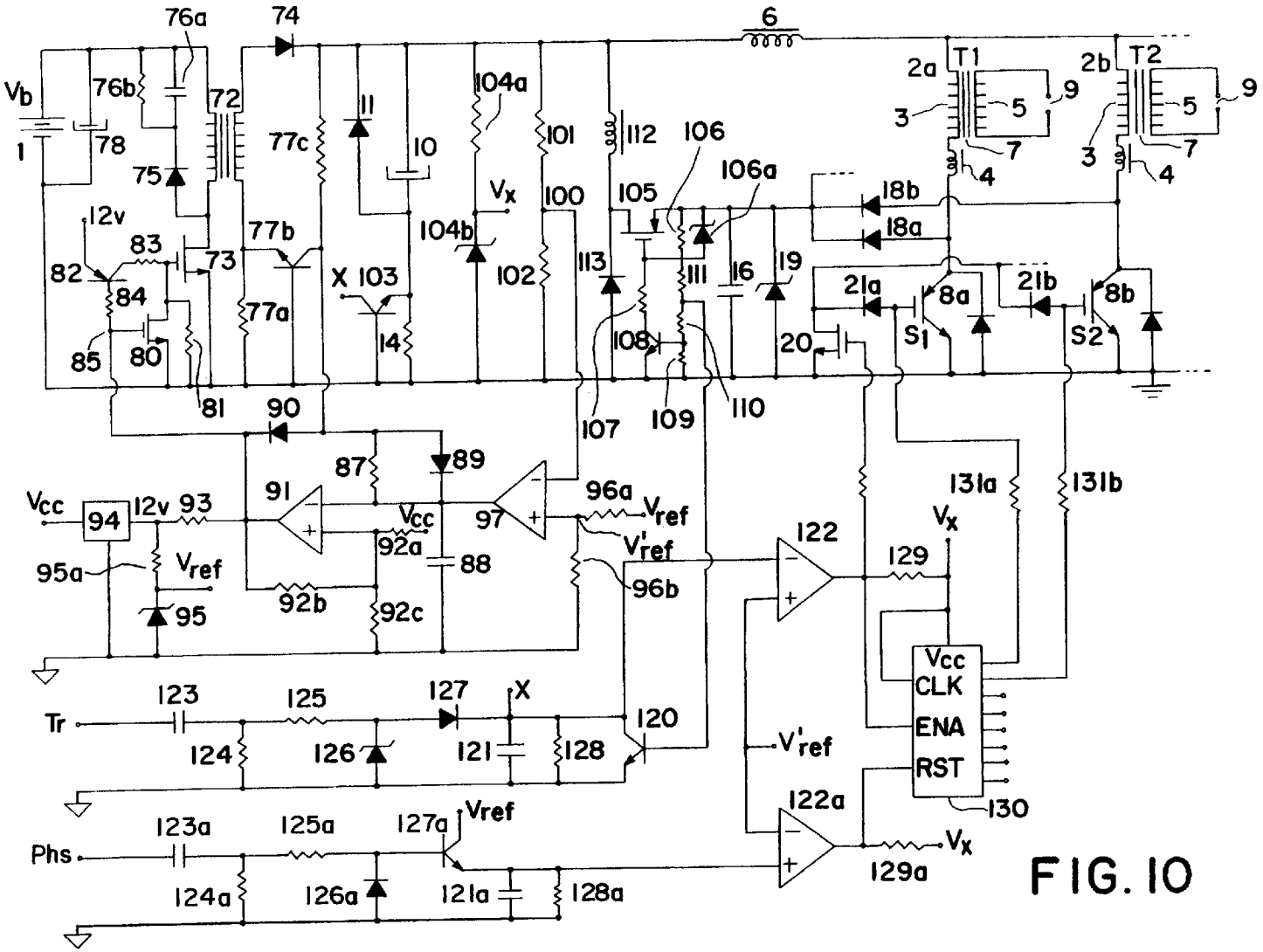
FIG. 10 is a detailed circuit drawing of a preferred embodiment of a complete HBI system with fly-back power converter, lossless snubber, and simple forms of power switch driver circuit and ignition control circuitry.

FIG. 1 is a partial block diagram, partial circuit diagram of an embodiment of the (HBI) ignition depicting the power converter (12) and trigger input ignition controller (13) as blocks to be shown in preferred embodiment form in FIG. 10, and depicting the preferred form of distributorless ignition of one coil and one power switch per spark plug (of a multi-cylinder engine), depicting two coils of any number of coils, and assuming for simplicity, where required, a conventional 4-cylinder engine with four coils and four power switches.

The ignition assumes operation from a 12 volt car battery 1 (voltage Vb), with two ignition coils 2*a* and 2*b* of several possible shown stacked in parallel (also designated as T1, T2, or more generally Ti, where the "i" designates the ith transformer coil). Each coil has primary winding 3 of inductance Lp, turns Np, and coil primary leakage inductance 4 (inductance Lpe) shown as separate inductors, secondary windings 5 of inductance Ls, turns Ns, terminating in a spark gap 9, and magnetic cores 7 of permeability M. In series with all the coils is a variable control (saturable) inductor 6 (of inductance Lsat) with an optional diode 6*a* across it. The coils 2*a*, 2*b*, . . . , each have a power switch 8*a*, 8*b*, . . . , (also designated as S1 and S2) in series with their primary windings. The remainder of the ignition power circuit includes energy storage capacitor 10 (with diode 11 across) charged to a voltage Vc from the power converter 12.

Capacitor 10 typically comprises high temperature electrolytic capacitors of higher voltage rating than Vc, e.g. 50 to 63 volt rating for Vc approximately 40 volts with Vc typically ranging from 24 to 80 volts depending on application. For simplicity, 40 volts will be assumed for the supply voltage Vc. Capacitance C of capacitor 10 is selected based on the ignition system requirements, with preferably two or three 50 or 63 volt rating in-parallel 270 to 1000 microfarads (uF) capacitors used for the typical automotive application.

In operation, one of the power switches Si is turned on by the controller 13 for the, "dwell" period Tdw to build up a prescribed peak or "break" current Ipo, measured by sensor resistor 14 connected between the low side of capacitor 10 and ground, and then opened to deliver the energy El stored in the magnetic core to the secondary coil circuit, where:

$$El=\tfrac{1}{2}\cdot Lp\cdot Ipo^2$$

where "•" denotes multiplication.

Coupling losses between the primary and secondary windings, switching losses, core losses, and secondary winding losses reduce the energy that is delivered to the spark gap 9 to typically 70% to 80% of the stored energy El. The coil coupling coefficient "k" is typically in the range of 0.85 to 0.95.

When the ignition is being operated, the coil switch Si (IGBT shown) is initially turned on to energize the core 7. During turn-on, the voltage on the coil secondary winding output capacitance 15 will rise to a voltage Vs' double that expected purely based on turns ratio and input voltage, given by:

$$Vs'=2\cdot N\cdot Vc$$

which for a turns ratio N of, say, 75 and a voltage Vc of 40 volts, will give an output voltage of 6 kV, enough to (false) fire the spark gap 9 (a capacitive discharge effect) under light load conditions, especially for engine deceleration. The voltage doubling effect is eliminated (halved) to reduce the turn-on voltage Vs' to half that value (3 kV) by use of the variable control (saturable) inductor 6 with initial inductance approximately 0.6 times the coil primary inductance Lp. Preferably, high initial relative permeability M powder iron material is used for the core (M of 75 to 85) which drops to about 1/10th the M value at the peak current Ipo, although ferrite material can also be used that saturates after a few amps of current Ip. Preferably, type E100 core (also designated E 24–25) with 40 to 60 turns of approximately # 20 AWG, American Wire Gauge, wire is used, depending on the requirement for the initial inductance Lsati (0.2 to 0.6 mH).

In the figure is shown a simple dissipative snubber whose purpose is to store, in snubber capacitor 16 and to dissipate it in shunt resistors 17*a* and 17*b*, the high frequency energy associated with both the coil leakage inductance 4 and variable inductor 6 which occurs upon power switch Si opening. Diodes 18*a*, 1 8*b* connected to the collectors of power IGBT switches 8*a*, 8*b* provide isolation between the power switches Si and prevent reverse current flow from the snubber capacitor. High voltage protection clamp 19 is included across the snubber capacitor 16 to limit the peak voltage. Capacitor 16 is such as to store energy comparable or greater than that stored in the coil leakage inductance 4 and variable inductor 6 at the peak primary current Ipo. The capacitance is typically greater than 0.2 uF and of 600 volt rating for the present application which preferably uses 600 volt IGBT power switches Si.

It is desirable to use the voltage spike at the opening of the power switch Si to provide a low voltage disabling signal of fixed duration for the input trigger. This can be done by using the voltage available at the divider point of snubber resistors 17*a*, 17*b* and supply it to the controller 13, which is disclosed in detail with reference to FIG. 10.

Numerous drivers for power switches Si are used by those versed in the art. A particularly simple one, fully disclosed elsewhere, is to connect an N-type FET switch 20 (or other type of semiconductor switch) with drain to the gates of the various switches Si through isolation diodes 21*a*, 21*b*, . . . , and its source to ground. The gate of the FET 20 is connected to the controller 13, whose operation is more fully disclosed with reference to FIG. 10.

Figure 2A:
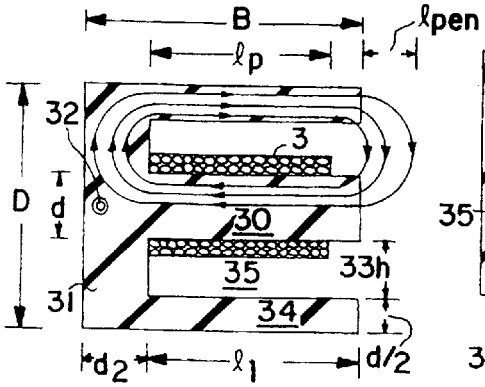
FIG. 2*a* is a partly to-scale partial side-view drawing (looking at the lamination flats) of a preferred embodiment of a laminated open E-core coil, usable in the FIG. 1 embodiment and elsewhere, of moderate stored energy of 150 mj to 200 mj, showing certain key lamination dimensions and the preferred two layer primary winding and one half of the magnetic field.

FIG. 2*a* is a partly to-scale side-view drawing of a preferred embodiment of the laminated open E-core for a coil of the present invention. Only the primary winding 3 is shown in this figure, made up of two layers of magnet wire (either round wire or flattened elongated wire) of preferably 40 to 80 turns (20 to 40 turns per layer) of 19 to 22 AWG (American Wire Gauge) magnet wire. The center leg 30 of the core is made up of stacked laminations with center leg width "d", which, with side legs 34 (width approximately d/2), define a winding window 35 of height "h" and length "$l_1$". Preferably back end 31 of laminations of width "d2" has a mounting hole 32.

A key aspect of this design is the absence of an I-lamination which is normally provided to form a closed core. Based on a simple text-book appraisal of the inductance of such a core structure, with its open end 33 defining an air gap of length of about "h", one obtains a primary inductance Lp about one order of magnitude smaller than the required primary inductance Lp of about 0.5 mH, for preferred primary turns Np of approximately 55 and preferred dimensions of the lamination of D approximately 2" (5 cms), primary wire winding length "lp" approximately 1" to 1.25" (2.5 to 3 cms, and "h" approximately 0.4" (1 cm) for a stored energy El of 200 mj to 300 mj. Actual measurements give a value consistent with the larger required 0.5 mH and equivalent air-gap of about 0.1" (0.25 cm). Furthermore, the magnetic field penetration depth Ipen is approximately equal to or less than the length of the coil encapsulated open end, minimally effecting the optimal operation of the coil.

For the preferred automotive application of El of 200 to 300 mj, preferred approximate values of the key parameters for suitable El are:

Lp=0.55 mH; Ipo=30 amps; Np=55; Am=2 sq. cm

El=250 mj and from the equation for the peak magnetic flux density Bpk, given by:

Bpk=[Lp•Ipo]/[Np•Am]

Bpk=1.5 Tesla which is ideally stressed (for Bpk approximately 1.5 Tesla assuming SiFe laminated oriented core material), with ideal magnetic stored energy in the core of approximately 250 mj for most automotive applications.

The preferred overall side dimensions B by D of the core for El of approximately 250 mj are approximately 2" by 1.8" (5 cms by 4.6 cms), the center leg width having a dimension "d" of approximately 0.6" (1.5 cm), i.e. an area Am approximately 2 square cms for a square center leg of thickness "d1" equal to "d", and a window height h of approximately 7/16" (1.1 cm) to provide enough secondary winding space for a low secondary winding resistance Rs of about 500 ohms for high efficiency at stored energy of approximately 250 mj. The width "d2" of the back end 31 of the lamination is preferably 1.5 times d/2 instead of equal to d/2 to provide more area to make up for reduced permeability at high magnetic flux densities, i.e. of the cross grain orientation of the back portion 31 (at approximately 1.5 Tesla based on the center leg core area Am). For lower energy, e.g. 150 mj, the coil would be overall smaller with center leg dimension "d" reduced, although the window height h would be kept at the approximately 7/16" (1.1 cm) for maintaining low secondary resistance Rs and for providing adequate high voltage margins. The coil primary resistance Rp is preferably about 0.15 ohms.

Figure 2B:
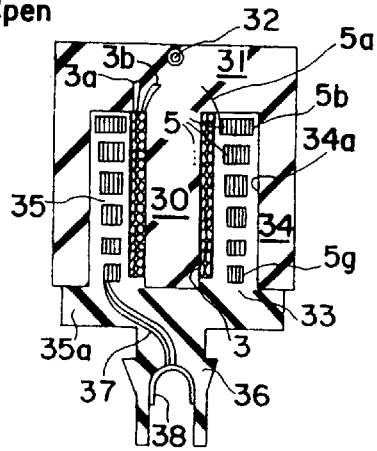
FIG. 2*b* is a side-view drawing of the lamination structure of the FIG. 2*a* embodiment built into an encapsulated cylindrical coil.

FIG. 2*b* depicts an approximately to-scale side view drawing of a preferred embodiment of a cylindrical coil based on the core of FIG. 2. Like numerals represent like parts with respect to FIG. 2. The coil is based on the design and parameters already disclosed and is made with the primary 3 and secondary 5 windings and segmented bobbin encapsulated into a cylindrical or rectangular cross-section unit 35*a* which protrudes beyond the open end 33 of the laminations, from which the concentric high voltage tower 36 extends to produce a mating nipple to which can be fitted a flexible insulating boot (not shown). Inside the tower 36 is a connector 38 connected to the secondary winding end 37 for contacting the spark plug high voltage terminal (not shown). The coil drawing is partly to-scale, shown approximately to-scale at 2.5" (6 cm) long but only approximately 1.5" wide instead of 2" (5 cm) wide for El=250 mj.

The secondary winding 5 is shown wound in six segments or slots (five to eight slots or more) indicated as shaded areas in the winding window 35. The margins between the secondary winding 5 and both the primary winding 3 and inside surfaces 34*a* of the outer lamination legs 34 increase along the coil length, the first uppermost, lowest voltage, secondary winding segment 5*b* having the smallest margins and the last, highest voltage segment 5*g* the largest margin, as is required and known to those versed in the art. This coil can store 200 to 300 mj of energy and transfer the energy at a high efficiency of approximately 75% to the spark assuming a spark voltage of 800 volts (a conventional way of specifying spark energy). The primary end wires 3*a* and 3*b* emerge at the back of the coil along with the low voltage end 5*a* of the secondary winding.

Figure 2C:
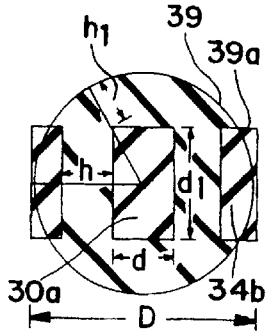
FIG. 2*c* is a bottom end-view of cylindrical cross-section coil showing a preferred rectangular core design providing an optimized circular cross-section.

The cross-section of the center leg of the coil can be either square (for the example given above) or rectangular as shown in FIG. 2*c* (or other shape such as round if commercially practical). FIG. 2*c* is a bottom end view of a cylindrical cross-section coil showing a preferred rectangular, versus square, core area based on an open E-laminated core providing an optimized circular cross-section for the coil. In this design, the larger core cross-section dimension "d1" is selected to equal 1.73 (√3) times the shorter dimension "d", or somewhat less than that, e.g. 1.6. This selection is based on producing a uniform winding window height for the circular cross section. That is, the window height "h" between the core center leg 30*a* and an outer core leg 34*b* is equal to the winding height "h1" which represents the minimum clearance between any part of the core leg 30*a* and a circle 39 whose diameter equals the core width D (where D equals 2·(d+h)). This gives an essentially circular (39) cross-sectional coil body, i.e. a cylindrical coil, excepting for slight protrusions 39*a* at the comers of the outer lamination legs, for a compact cylindrical structure.

For coils with large stored energy El (and large spark energy), e.g. 300 mj to 600 mj stored energy, this design is particularly useful, with stored energies of approximately 400 mj being, achievable with a coil cylindrical body diameter of only 5 cms and 4.5 cms length (90 cc volume) and approximately 50 turns Np of primary wire (and turns ratio N of 75).

Figure 3:
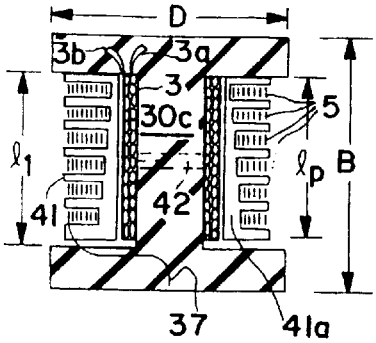
FIG. 3 is an approximately to-scale side-view drawing of an open I-type (bobbin type) core of approximately square overall dimensions showing the preferred two layer primary winding and the secondary winding in a preferred segmented tapered bobbin.

FIG. 3 is an approximately to-scale side view drawing of an open I-type (bobbin-type) core coil of approximately square overall dimensions, i.e. B is approximately equal to D, for a stored energy of 150 to 200 mj, with the coil appropriately dimensioned for other stored energy levels, i.e. larger for higher energy, and vice-versa. Shown is the primary winding 3 (and ends 3*a*, 3*b*), the secondary winding 5, and the actual segmented bobbin 41 on which the coil secondary winding 5 is wound. The primary winding 3 is shown concentric with the secondary winding, filling a length lp somewhat less than the available winding length $l_1$ (lp being approximately 90% of $l_1$). Preferably, the number of primary turns Np is approximately 50 turns of number 29 to 22 AWG magnet wire. The secondary winding is approximately 4000 turns of magnet wire wound in the segmented bobbin 41 with five to eight segments (six shown), or more as is known to those versed in the art, with lumber 34 to 38 AWG magnet wire for a total secondary resistance of 400 to 1000 ohms, preferably approximately 500 ohms. The high voltage wire end 37 is brought out axially at the bobbin end for an "I" orientation of the coil (versus an alternative "H" orientation, not shown, where it can be brought out the side, a in the block coil of FIG. 5). A higher secondary winding fill of the bobbin 41 is practical in this design, as shown, because of the lack of core side-walls 34 (FIGS. 2*a*, 2*b*). The bobbin 41 has a tapered bottom 41*a* to handle the increasing voltage along the bobbin length, known to those versed in the art.

This design is particularly suited for including a central air gap 42 in the central core section 30*c* since the core can be made up of two symmetrical sections. The gap can include a biasing magnet to increase the capability of the core (so it can be driven harder since in this application the peak core magnetic flux is in one direction). Even without the biasing magnet, a simple air-gap may be an advantage since it will both reduce the inductance, which by design can be made to have an appropriate value and will allow the core to be driven harder, i.e. to a higher peak magnetic flux of 1.5 to 1.8 Tesla before the magnetic properties of the material begin to limit its operation.

Figure 4:
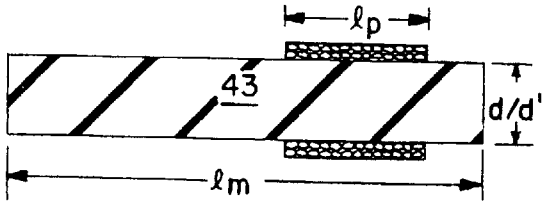
FIG. 4 is a side-view drawing of an equivalent magnetic core and primary winding of the cores of FIGS. 2*a* and 3 for obtaining an approximate formula for the coil primary winding inductance Lp.

A model has been developed for analyzing the primary inductance of the open E-core and bobbin cores with the preferred thin two layer primary winding, based on the assumption that the ratio of the magnetic length lm to average core diameter d is less than 8, i.e. lm/d<8. For non-circular cross-sectional area cores an equivalent diameter d' corresponding to a circular area is used. FIG. 4 shows the magnetic equivalents of the E-core the "I" or bobbin core having a central primary winding of length lp) in the form of stretched out linear equivalent core 43 with magnetic length lm and winding length lp. For the E-core, the magnetic length lm can be taken as 2B+D/2; for the bobbin core it can be taken as D+B. Under these assumptions, the primary inductance Lp is given approximately by:

$$Lp=0.02\cdot Ma\cdot[(d'\cdot Np)^2]/[lp]uH$$

where the dimensions are given in inches and Ma is the well known apparent permeability of a straight core of permeability Mm and given ratio lmd'. The coefficient 0.02 is a weak function of the window width "h" (relative to the overall coil dimensions).

For example, taking an open E-core design with stored energy of approximately 200 mj, and assuming t square SiFe laminated core dimensions of side d=½", or d'=0.56, lp=1.0", and assuming 60 turns of #20 AWG magnet wire for the primary winding, and lm=3", one obtains:

$$Lp=0.02\cdot Ma\cdot[(33.6)^2]/[1]uH=22.6\cdot Ma\ uH$$

and for the SiFe laminated core with permeability Mm above 1000 and lm/d' ratio of 6, Ma is equal to 20 (where "equal to" is taken to be within 10% of the value it qualifies unless otherwise stated). This gives approximately:

$$Lp=450\ uH$$

For the preferred assumed peak primary current Ipo of 30 amps, the stored energy El is approximately 200 mj as preferred. The peak magnetic flux density Bpk given the core area Am of 1.5 square cm:

$$Bpk=[4.5\cdot 30]/[60\cdot 1.5]=1.5\ Tesla,$$

a preferred value for peak magnetic stress, and hence an optimum design.

In the applications disclosed the coils are expected to be placed near the spark plug and are not ideally suited for spark plug mounting. Two designs, a block coil (FIG. 5) and pencil coil (FIG. 6) are suited for spark plug mounting, the pencil coil ideally suited for spark plug mounting in the spark plug well.

Figure 5:
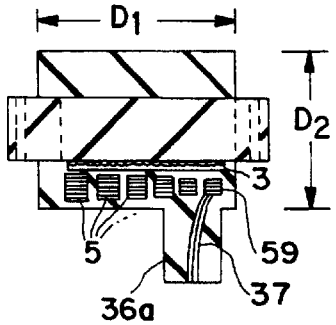
FIG. 5 is a cutaway side-view drawing of the structure of the FIG. 2*a* embodiment built into a block coil for more suitable mounting onto a spark plug.

The block coil of FIG. 5 uses the preferred open E-structure of the present low primary inductance Lp, high primary current Ipo. The drawing is an approximately ⅔ scale cutaway drawing of a side-view of a moderate energy, approximately 200 mj block coil. Core width "D" and core body length "D1" are approximately equal at 4½ cms (1.75"), and coil height "D2" is approximately 3 cms (1.25"). The core center leg cross-section is square to minimize the coil height "D2". The winding window height "h" is approximately 1.6 cm (0.4") to limit the overall core height. The coil has a primary winding 3 (preferred two layer), segmented secondary winding 5 with six segments as in FIGS. 2*b* and 3 (shown only in the cutaway section, and a high voltage tower 36*a* which is located near the right most, high voltage end of the coil, with the high voltage wire 37 shown emerging from the last segment 5*g* of the secondary winding to connect to the high voltage tower 36*a*. The tower end 36*a* can be of a range of designs to accommodate a boot for mounting onto the spark plug.

Figure 6:
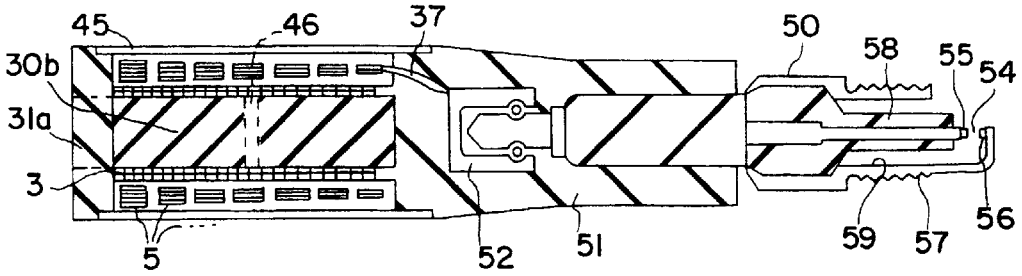
FIG. 6 is a side-view, approximately to-scale drawing of a plug mounted cylindrical coil including a spark plug boot and spark plug.

FIG. 6 is a side-view, approximately to-scale drawing of such a plug-mounted cylindrical coil which is designed to have an overall small diameter (which can be as small as 23 mm outside diameter (OD) of the preferred automotive industry standard pencil coil). It has a hybrid core structure with center core 30*b* made of either low cost iron powder material, laminations of various widths, bunched circular or hexagonal cross-section wire, etc., with the back end flange 31*a* made up preferably of low cost iron powder material, and outer cylindrical section 45 made of thin, about 1/16" (1.6 mm) thickness "t" material or greater as required, made up of wound, SiFe, 2 to 5 mil tape, or other magnetic tape, or of single thickness high resistivity material with skin depth (at the coil low operating frequency f0) approximately equal to the thickness "t". For the case where the center core section 30*b* and end flange 31*a* are made of preferred newly developed low cost powdered iron of permeability Mm approximately equal to 25 (versus 20 at a high magnetic field H of 200 Oersted), one can significantly improve the design by including a biasing magnet 46 at the center of the cylindrical core section 30*b* (whose air gap will also improve overall performance and still provide the minimum 0.25 mH primary inductance Lp). The primary winding 3 is preferably made of two layers of flattened magnet wire, of 60 to 120 turns, where the degree of flattening can also effect and control the primary inductance through the ratio $Np^2/lp$. The secondary winding 5 is segmented, with seven segments shown in this case of a relatively long core.

For stored energy El in the range of 125 to 300 mj, the center cylindrical core diameter is between 0.35" (0.9 cm) and 0.8" (2 cm) and outside cylindrical diameter D is between 0.9" (23 mm) and 2" (5 cms) (or greater if required). The winding window height h is between 0.2" (0.5 cm) and 0.45" (1.1 cm), and the core length can vary over a wide range, from 5 cm and up, depending on the requirements for stored energy and the constraints on the diameter.

In the preferred embodiment of 23 mm pencil coil wherein various width laminations are used for the center core with air-gap, approximately 100 turns of primary wire are used for primary inductance of approximately 0.3 mH, to give a stored energy equal to 150 mj for a peak current equal to 32 amps. In a preferred embodiment, the primary wire is flattened magnet wire wound over the 50 to 70 mm core length in two layer, preferably #20 to #22 AWG, and the secondary wire is preferably #36 to #39 AWG, with a turns ratio N equal to 75.

In this figure is also shown a preferred spark plug 50 connected to the end of the coil through a semi-rigid thick walled boot 51 which, in this case, is shown to encase a connector 52 which terminates the high voltage winding with end wire 37. Alternatively, the open core, high voltage end can terminate in a high voltage tower such as 36 of FIG. 2*b*, to which is connected a boot.

With respect to the spark plug 50, a preferred design is one with a large spark gap 54 of approximately 0.08" (2 mm) which can be fired by the present high energy coils with their inherent high (36 to 50 kV) peak output voltages Vs. Preferably, the plug end electrode tips 55 and 56 are of erosion resistant wire, e.g. about 1 mm cylindrical tungsten nickel-iron or other erosion resistant material buttons. The plug gap is shown protruding from the spark plug shell 57 for good spark penetration and for increased spark voltage to improve the spark efficiency and reduce the spark energy dissipated in the coil secondary winding 5, especially at high duty cycle operation (high engine speeds). The insulator 58 is thin and the shell interior 59 of large diameter to create the largest practical clearance between the insulator 58 (and center electrode 55) and the inside shell wall 59, to allow for a large spark gap 54 without back firing (or pocket spark as it is referred to). The low inductance of the present design coil results in a faster than normal rise time which aid in preventing back firing.

For the cylindrical and block coils disclosed, three equations are required to determine the design, the equation for the peak magnetic flux density Bpk, the equation for the primary inductance Lp and the equation for the energy El. It can be seen that for the design of coils for the present application (open E-core and open cylindrical cores), some flexibility in design is available in terms of adjustments in the number of primary turns Np, the core area Am, the primary winding length lp (which can also be adjusted for the same number of turns Np by flattening the magnet wire to various degrees), the magnetic path lm and ratio of Im/d' (hence Ma), etc. These can be adjusted to give suitable inductance Lp so that for the desired operation the peak flux density Bpk is in the desired range of 1.4 to 1.8 Tesla for SiFe, and lower for powder iron.

In the cores shown, the preferable materials are low cost SiFe laminations (typically 14 mil) or high inductance powder iron as are currently being developed (advantage of round center core but lower permeability). However, one is not limited to these as already mentioned. A center core can be designed to be made up of bunched steel/iron wire which is preferably of polygon cross-section (e.g. square, hexagon, etc.) for maximum packing factor. Wire diameter can be relatively large, e.g. about 1/16" (1.6 mm) as dictated by the operating frequency f0 of the ignition system (and hence the skin depth) which is typically about 1 kHz, i.e. 0.5 to 2 kHz.

Figure 7A:
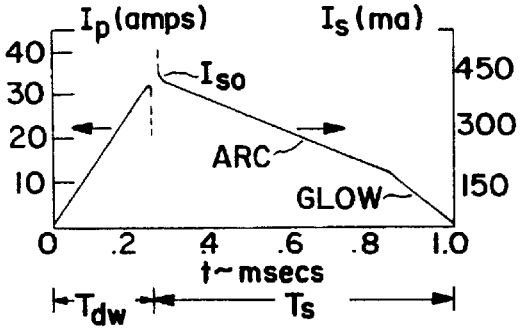
FIG. 7*a* is a plot of a typical coil primary charging current Ip and the secondary spark firing current Is for the present ignition application.

Operating frequency f0 is obtained from FIG. 7*a*, which shows a typical primary coil charging current Ip and the secondary spark firing current Is for the present application. The period T is made up of the charging period Tdw and spark period Ts, shown to be 1 msec (typically between 1 msec and 2 msec). This represents an operating frequency of about 1 kHz. For the typical resistivity and permeability of various steel/iron, i.e. ferrous materials, this gives a skin depth of about 1/16" (1.6 mm) which allows for bunched wire of diameter 1/16".

Figure 7B:
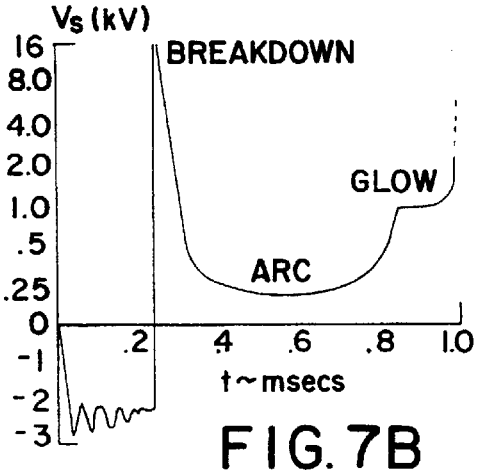
FIG. 7*b* is a plot of the spark gap voltage corresponding to the coil current waveforms of FIG. 7*a*.

FIG. 7*b* shows the spark gap voltage corresponding to the coil current waveforms of FIG. 7*a*. Noteworthy is the limited initial peak voltage of approximately −3 kV (versus −6 kV or higher due to voltage doubling) brought about by the use of the saturating inductor 6 of FIG. 1. Noteworthy also is the higher initial spark current Iso which produces a low voltage high current (200 to 500 ma) arc discharge not normally found in inductive ignition systems.

Upon spark firing, the spark discharge proceeds from a very high voltage (many kV) high efficiency breakdown spark, to a low electrode voltage drop moderate efficiency arc discharge, to a moderate electrode drop, low efficiency glow discharge at approximately 200 milliamps (ma). The 300 ma spark shown is in the transitional discharge region, having some arc discharge characteristics, which under moderate engine flow conditions are superior in preventing spark segmentation (spark break-up) and hence improve "useful" spark energy. This is important in modern engines, as in lean burn engines with high flow and racing engines. Therefore, with the present design of low primary inductance Lp of about 0.5 mH and high break current Ipo of 20 to 40 amps or higher, and low turns ratio N of approximately 75 made possible by currently available 600 volt rating IGBTs, one achieves spark currents which dominate in the arc (or transitional) discharge mode of 200 ma to 500 ma or greater.

It is to be noted that the high stored energy will provide high peak output voltage with a practical limit of 50 kV dictated by the coil insulation properties. In fact, one of the problems of high energy inductive ignitions, especially in the present case of high efficiency transfer, is the naturally high output voltage, especially if the spark plug load is disconnected, obtained from the relationship:

$$\tfrac{1}{2}\cdot Cs\cdot Vs^2=\tfrac{1}{2}\cdot Lp\cdot(k^2)\cdot(Ipo^2)$$

$$Vs=SQRT(Lp/Cs)\cdot k\cdot Ipo$$

where Cs is the coil secondary open circuit output capacitance, Vs is the peak output voltage, k is the coil coupling coefficient, and SQRT means "square root".

For a case of only 100 mj an open circuit voltage Vs of 60 kV is easily attained which can destroy the coil assuming the coil is designed to withstand a maximum peak output voltage Vs o 50 kV (although in special applications that can be increased to 60 kV). The way of protecting the coil is to limit the peak output voltage Vs by clamping the corresponding primary voltage (by clamp diode 19, FIGS. 1, 10), which rises by transformer action to a value approximately equal to Vs/N (N is the turns ratio).

Figure 8A:
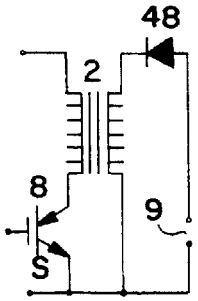
FIG. 8*a* is a partial drawing of an ignition coil circuit used with the fast charging circuit of the present HBI system, i.e. the FIG. 1 and 2*a* and all other embodiments, including a diode on the output of the coil to permit high duty cycle multi-firing of the ignition spark.
Figure 8B:
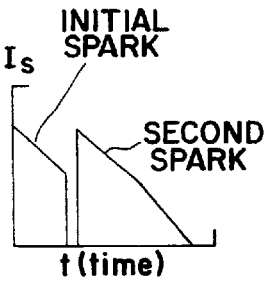
FIG. 8*b* is a spark current output of the circuit of FIG. 8*a* representing two sequential spark firings of high duty cycle.

FIG. 8*a* is a partial drawing of an ignition coil circuit including a transformer coil 2 (with its leakage inductance not explicitly shown), switch 8, and an output diode 48 (assuming negative coil secondary voltage) which permits high duty cycle multi-firing of the ignition spark. Output isolation diode allows the coil switch S to be turned-on during spark firing (since turn-on output voltage is of opposite polarity to the spark firing voltage) to charge the primary inductance, and open the switch S during the initial spark firing to produce a second spark, as shown in FIG. 8*b* (or more than two sparks if desired). Since the charging time (dwell time Tdw) is short relative to the spark firing time because of the high input voltage Vc (which can be even higher, e.g. 60 volts, the spark firing duty cycle can be above 90%. Note that the inclusion of variable control inductor 6 is still useful here since it can reduce the voltage requirement of the diode 48, which must also handle the peak current of the coil secondary capacitance dumping its charge through the lower secondary winding resistance Rs of the present application, for peak (short-lived) currents in the tens of amps.

FIGS. 9*a* to 9*d* show approximately to-scale drawings of cores for either the power converter transformer 72 or the snubber inductor 112 of FIG. 10. The cores feature a winding window "h" of approximately 0.16" (4 mm), narrower than conventional, for both the preferred two layer winding of transformer 72 and the preferred five to eight layer winding of the snubber inductor 112.

Figure 9A:
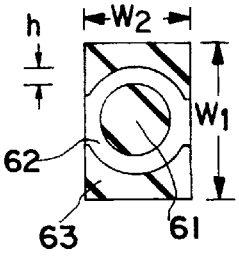
FIGS. 9*a* to 9*d* are various views of preferred cores for use in the transformer of the preferred DC-DC fly-back converter and for the snubber inductor.

FIG. 9*a* is an approximately to-scale top-view drawing showing the preferred round center core 61 of diameter preferably between 0.4" (1 cm) and 0.5" (1.3 cm), narrow winding window 62 (width "h"), and rectangular base 63 of dimensions W1 by W2, approximately 1.0" (2.5 cm) by 0.6" (1.5 cm). The core material is preferably ferrite for transformer 72, and the special, low cost, high capability powder iron (permeability of approximately 25 at 200 Oersted) for the snubber inductor 112.

Figure 9B:
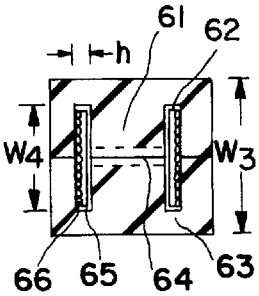

FIG. 9*b* is an approximately to scale side-view drawing of the core of FIG. 9*a*, with like parts having like numerals with respect to FIG. 9*a*. The core is a two part symmetrical core of height W3, approximately 1.0" (2.5 cm), with a central air gap 64 to provide the appropriate inductance and peak flux density Bpk. For the transformer 72, preferably the primary turns Np are between 12 and 20, preferably equal to 16 turns of 19 to 22 AWG wire, with turns ratio N (Ns/Np) of approximately 1.6, inductance Lp is about 40 uH, and Bpk is about 0.2 Tesla at a peak current of 10 amps. For the snubber, preferably 200 to 300 turns of 25 to 30 AWG magnet wire are used for total resistance about 2 ohms, for preferred inductance Lsn of about 4 mH, and Bpk of about 0.6 Tesla at a peak current of approximately 4 amps. In the drawing is shown the preferred winding for the transformer, a single layer secondary winding 65 with a single layer primary winding 66 on top filling most of the window winding length W4.

Figure 9C:
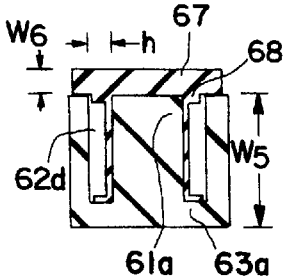

FIG. 9*c* shows an alternative to the embodiment of FIG. 9*b* with a single open core (of the general E-type uses in the disclosed coils) of height W5 with single center leg 61*a*, winding window 62*a* open at the top end, single core base 63*a*, and bobbin 67 which also acts as a mounting fixture. The bobbin is shown to have a top thickness W6 approximately equal to the penetration length of the fringing magnetic fields to define a minimum required clearance dimension between the open end 68 of the core and an electrically conducting surface.

Figure 9D:
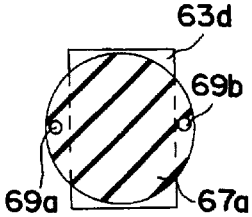

FIG. 9*d* shows a top-view of the structure of FIG. 9*c* with base 63*a*, bobbin top 67*a* of the bobbin 67, and mounting holes 69*a* and 69*b* for mounting the structure to a surface, which can include a circuit board where the mounting holes can double up as the inductor winding lead wires. The core structures are only usable where a large air-gap is required, as is the present case for both the transformer 72 and snubber inductor 112.

FIG. 10 is a detailed circuit drawing of a preferred embodiment of a complete HBI system with a high efficiency and simple fly-back DC-DC power converter, variable control inductor, lossless snubber, and simple forms of power switch driver and ignition control circuitry. Like numerals represent like parts with respect to the previous figures.

The power converter 12 is made up of a flyback transformer 72, field-effect transistor (FET) switch 73 (or other transistor switch), and output diode 74 (preferably ultra-fast recovery) to charge energy storage capacitor 10. Typically, FET 73 is a low RDS, e.g. 28 to 50 milliohm, 50 to 60 volt FET. The power converter preferably uses snubbing circuit made up of diode 75, snubber capacitor 76*a*, and snubber resistor, 76*b*. Current sensor 77*a*, sensor transistor 77*b*, and off-time converter timing resistor 77*c* are used as disclosed in U.S. Pat. No. 5,558,071 to produce continuous operation with a DC current. An input capacitor 78 (Cin) is used for reducing noise and for confining the power converter currents in a small loop.

For a typical 4-cylinder car application a power converter output of approximately 40 watts may be adequate, achieved a by switching transformer 72 peak primary current Icnv of approximately 10 amps, e.g. 5 amps DC and 5 amps AC (Icnv(AC)), using a small gapped core for transformer 72, e.g. an ETD-29 core, but preferably cores disclosed with reference to FIGS. 9*a* to 9*d* with the primary and secondary turns disclosed, and primary inductance Lcnv of approximately 40 microHenry (uH). For this case, the switch on-time Ton is approximately 16 microseconds (usecs for a 13 volt battery, which is defined according to:

$$Ton=Icnv(AC)\cdot Lcnv/Vb=5\cdot 40/13 \text{ usecs}=16 \text{ usecs}$$

and the off-time is approximately 5 usecs for an output voltage Vc of 40 volts.

The driver of the FET switch 73 is a novel driver comprised of a turn-off N-type FET switch 80 (or other switch type) with a resistor 81 across it, connected directly between the gate of the power FET switch 73 and ground, and a turn-on PNP transistor 82 with emitter taken to the regulated 12 volt point (designated 12v) and collector to the gate of power FET 73 through resistor 83, with resistor 84 connected between base of transistor 82 and gate of FET 80 which is the driving point 85. When drive point 85 is pulled low, power FET switch 73 is turned on, and when it is taken high switch 73 is turned off.

Timing control of FET switch 73 is provided by the timing circuit comprised of off-time resistor 77*c* (Rc), on-time resistor 87 (Rb), timing capacitor 88, diode 89 shunting resistor 87, isolation diode 90, and comparator 91 functioning as an oscillator. The Oscillator off-time Toff is reduced with increased output voltage Vc (as optimally required) by more rapid charging of timing capacitor 88 through resistor 77*c*. The oscillator on-time Ton is reduced with increasing battery voltage Vb o provide approximately constant peak primary current in transformer 72 for 12 to 30 volts battery voltage Vb, achieved by tying resistor 92*a*, connected to the non-inverting input of the comparator 91, to the battery switched voltage Vcc (essentially equal to Vb), tying the comparator output and one end of resistor 92*b* to 12v (not to Vcc) through a resistor 93 of much smaller value, e.g. 2.2 kohm, and the other end of resistor 92*b* to the comparator non-inverting input, to which third oscillator resistor 92*c* is connected to ground. Resistors 92*a* and 92*b* are of approximately equal value, e.g. about 39 K, and resistor 92*c* is of approximately half the value (about 18 K). The output of comparator 91 drives the drive point 85 of the switch 73 driver circuit directly, turning the power switch on when the output goes low, and the switch off when the output goes high, as already mentioned.

Two reference voltages are provided, a 12 volt reference (designated 12v) which is based on a standard automotive low drop-out regulator 94 with output capacitor (not shown) and a five volt zener diode 95 (standard 5.1 volt zener diode) of reference voltage Vref connected to 12v through resistor 95*a* of about 470 ohms for the low current requirements of a few milliamps. The reference voltage Vref is divided by voltage divider resistors 96*a* and 96*b* to a lower reference voltage V'ref which is applied to the non-inverting input of a regulator comparator 97 whose inverting input is connected to a voltage regulation point between divider resistors 101 and 102 cross the output voltage Vc, used to regulate the output voltage Vc. Selection of resistor values for the on and off times of switch 73 to provide the required operation can be obtained from study of disclosure of U.S. Pat. No. 5,558,071.

In FIG. 10 is also disclosed a preferred embodiment of a lossless (actually low loss) snubber whose purpose is to store high frequency energy associated with both the coil leakage inductance 4 and saturating inductor 6 (and to a lesser extent with the lower frequency output voltage Vs, if pertinent) to deliver the energy back to the energy storage supply capacitor 10. When a power switch Si is opened, the voltage on the switch rises to charge the snubber capacitor 16 at the high frequency defined by the resonance of the inductances 4 and 6 and capacitance Csn of capacitor 16, followed by a lower frequency charging produce by the transformed (Vs/N) rising output voltage Vs of coils 2*a*, 2*b*, . . . , with a rise time constant of typically 10 to 20 microseconds. Value of inductor 112, Lsn, is selected to only partially discharge capacitor 16 during the rise time for best operation, e.g. with preferably about 4 mH inductance value.

The lossless snubber is comprised of the snubber capacitor 16, a P-type FET 105 with its source connected to snubber capacitor 16, with a source to gate resistor 106 and protection zener diode 106*a* across it, with a gate resistor 107 in series with an NPN control transistor 108 whose emitter is grounded, and which turns FET 105 on and off. Resistor network in series with resistor 106 to ground provides the drive for control transistor 108 (base emitter resistor 109) and for disabling switch 120 (series resistors 109, 110, and 111). The circuit is designed to turn switch 105 on rapidly as the snubber capacitor 16 charges up. Switch 105 is turned off by control switch 108 when the snubber capacitor drops to a low voltage, say 80 volts so that 100 volt rating switches 105 and 108 can be used, and in such a way as to provide enough gate drive to FET 105, say 7 volts, just before turn-off, and 2 volts after turn-off (for relatively quick turn off). Possible values for resistor 107 is 4.7 kΩ, 10 kΩ for sum of resistors 110 and 111, 75 Ω for resistor 109, and 220 Ω for resistor 106. Divider 111, 110 is selected to provide the required drive for a defined disabling duration of the input disabling switch 120.

Snubber inductance is in the range of millihenries (mH), translating to a peak switch 105 current of one to several amps. Inductor 112 charging time is in the tens of microseconds or longer range, and the discharging time is in the hundreds of microseconds range. When switch 105 is turned off, the energy in the snubber inductor finds a path through diode 113 (connected in series with it to ground) and capacitor 10 to return energy stored in it to the supply capacitor.

Controlled termination of coil power switches Si charging current (time Tdw) is achieved by means of the sensor NPN transistor 103 whose collector is taken to an appropriate control circuit (a timing capacitor 121 in the trigger input circuit shown in this case). When a power switch Si is turned on, capacitor 10 begins to discharge, and voltage Vsense (due to current flow through sense resistor 14) at the emitter of sense transistor 103 falls (becomes more negative) until it reaches the base emitter threshold voltage Vbe (0.6 volts), turning on sense transistor 103, discharging timing capacitor 121, which flips the output of comparator 122 high to turn on control switch 20 which pulls all the gates of the switches Si low and turns them off (including the one that was on). Upon switch Si turn-off, disabling switch 120 is turned on, keeping the comparator 122 inverting input low and its output high (which keeps switches Si off) to disable the trigger input from spurious input signals (for a period of typically the order of magnitude of msecs) determined by the values of snubber capacitor 16, snubber resistors 106, 109, 110, 111, and the threshold voltage of switch 120.

The ignition controller used in this embodiment is a particular simple one, of many possible, which assumes a positive trigger signal Tr (pulse or step) and positive phase signal. The trigger input, has a differentiating input capacitor 123 and resistor 124 (taken to ground), a time delay resistor 125, zener reference diode 126 close to Vref zener voltage, and an isolation diode 127 through which the timing capacitor 121 is charged. Across the timing capacitor is a slow discharge resistor 128 and the disabling switch 120. Sense transistor 103 has its collector connected to the capacitor node X to discharge the timing capacitor 121 and turn switch Si off when the set peak primary current Ipo is attained. Node point X also connects to the inverting input of control comparator 122, whose non-inverting input is at the reference voltage V'ref, to flip its output when the capacitor is charged and discharged. Output of comparator 122 is taken to a voltage level Vx through pull-up resistor 129. Voltage Vx is a voltage approximately equal to 15 volts, obtained from the supply Vc by connecting resistor 104*a* and zener diode 104*b* between Vc and ground, with the zener diode setting the voltage point Vx.

The phase input circuit, which resets the octal counter 130, is modelled after the trigger circuit so that components that play similar roles are given the same numerals with the suffix "a". The positive signal phase input Phs uses a differentiating capacitor 123*a* and resistor 124*a*. However, while functionally similar, beyond that point the circuit differs from the trigger circuit in that an emitter-follower NPN transistor 127*a* is used to provide a high impedance to the phase input (and the voltage reference and the isolation), with its base connected to input base resistor 125*a*, its collector connected to a reference voltage Vref, and its emitter to capacitor 121*a* and discharge resistor 128*a*. The base-emitter diode of the transistor 127*a* plays the isolating role of diode 127, and the reference voltage Vref provides the limiting reference voltage for the noninverting input of comparator 122*a* (so diode 126*a* can be a simple diode versus a zener in the case of diode 126). In this case (versus for the case of the trigger circuit), comparator output is normally low, with its inverting input connected to a reference voltage V'ref well below Vref, e.g. 2.5 volts. The output of the comparator 122*a* has pull-up resistor 29*a* to the voltage Vx, which as already stated, is approximately 15 volts to be able to drive industrial type IGBT's (which preferably comprise the power switches Si) which require higher gate drive than more conventional clamped ignition IGBTs. Likewise, clock (CLK) input and VCC input of octal counter 130 are connected to Vx. By connecting output of trigger comparator 122 to the enable (ENA) input, and output of phase comparator 122*a* to the reset (RST) input, as disclosed in U.S. Pat. No. 5,558,071, proper phasing and actuation of the octal counter 130 outputs connected to the power switch Si gate resistors 131*a*, 131*b* is obtained. That is, with the clock (CLK) input kept high, the outputs of the octal counter will shift when sequential low signals (GO) are received at the enable (ENA) input.

Until now there has been no way to scale required ignition energy with type and operation of engine so as to determine required energy. It is claimed that for most applications standard spark energy (SSPE) in the range of 125 to 500 mj is required for maximum engine dilution tolerance. A model is disclosed for doing this using data obtained from Robert Bosch and General Motors.

The model assumes that an ignition is optimized with respect to maximizing engine dilution tolerance when it ignites the same fraction of mixture volume $V_{ign}$ to engine volume $V_{eng}$ assuming a two dimensional model, and assuming mixture is swept through the electrode gap (Gi or GAP) in proportion to piston speed (SPEED), i.e.

$$V_{ign}/V_{eng}=\text{constant}$$

$$V_{ign}=\text{constant}\cdot GAP\cdot SPEED\cdot Tsp$$

$$SPEED=\text{constant}\cdot STROKE\cdot RPM$$

$$V_{eng}=\text{constant}\cdot STROKE\cdot BORE$$

where BORE and STROKE designate the engine bore and stroke dimensions, and Tsp is the spark duration. Substituting, one obtains:

$$V_{ign}/V_{eng}=\text{constant}\cdot GAP\cdot RPM\cdot Tsp/BORE=\text{constant}$$

$$Tsp=K\cdot BORE/[GAP\cdot RPM]$$

$$K=Tsp\cdot[GAP\cdot RPM]/BORE$$

Using data from tests conducted at Robert Bosch and GM for minimum energy for maximum dilution tolerance, one obtains respectively values for the constant K (for the average spark current Isp(ave) of 80 ma and the average spark voltage Vsp(ave) of 800 volts):

$$K(Bosch)=2\cdot[0.048''\cdot 2000]/3.0''=64\ \text{RPM-msec}$$

$$K(GM)=5\cdot[0.040''\cdot 1200]/3.6''=67\ \text{RPM-msec}$$

so a good value for the constant K is 65 RPM-msec, i.e.

$$Tsp=65\cdot BORE/[GAP\cdot RPM]$$

Spark energy (Esp) for an ignition spark is given by:

$$Esp=Isp(ave)\cdot Vsp(ave)\cdot Tsp$$

By selecting a typical operating speed for an engine, one can obtain the required spark duration Tsp and spark energy Esp from the above equations for an assumed spark current and assumed spark gap voltage.

The model for the typical engine and ignition that is proposed is a 3.6" bore engine operating at a speed of 1800 RPM. Taking a constant spark current Isp(ave) of 100 ma (using the Bosch data) and estimated spark voltage Vsp(ave) of 800 volts for a spark gap of 1.5 mm (below the ideal 2 mm proposed herein), one obtains for the spark duration and energy:

$$Tsp=65\cdot 3.6''/[0.06''\cdot 1800]$$

$$Tsp=2.2\ \text{msecs}$$

$$Esp=0.1\cdot 800\cdot 2.2=175\ \text{mj}$$

This translates to a "standard spark energy", SSPE, of approximately 200 mj, or coil stored energy of at least 250 mj (assuming 80% efficiency energy transfer between coil energy storage and 800 volt zener load), used as the reference energy for the HBI coils disclosed which have three times the industry standard maximum stored energy of 80 mj (for the same size).

It is also required to insure that the stored energy El is delivered efficiently to the spark gap, and more particularly to the spark plasma. The efficiency of delivery EFF to the spark plasma, for an assumed triangular spark current distribution, is given by:

$$EFF=(½)\cdot Isp\cdot Vpl\cdot Tsp/[(½)\cdot Isp\cdot Vsp\cdot Tsp+(⅓)\cdot Isp^2\cdot Rs\cdot Tsp]$$

$$EFF=1/[1+Vel/Vpl+(⅔)\cdot sp\cdot Rs/Vpl]$$

where Rs is the coil secondary winding resistance, and Vsp=Vpl+Vel. For a typical glow discharge ignition (Isp=0.08, Rs=2000, Vpl=110, Vel=330), $$⅔\cdot Isp\cdot Rs/Vpl=1$$

$$EFF(glow)=1/[1+3+1]=⅕$$

The arc discharge efficiency equals the glow discharge efficiency if:

$$⅔\cdot Isp\cdot Rs/Vpl=3.2$$

$$Rs=4.8\cdot Vpl/Isp$$

For a 400 ma (peak) arc discharge spark with spark gap 1.5 mm, Vpl=63 volts, Vel=50 volts for a low turbulence mixture (worst case), giving $$Rs=4.8\cdot 63/0.4=750\ \text{ohms}$$

Therefore, the coil secondary resistance Rs in the typical HBI coil design should be preferably below 750 ohms for an arc discharge of peak current of 400 ma. Also, by using a wide, extended gap plug (FIG. 6), and placing it well into the combustion chamber (practical for the HBI system), the plasma voltage Vpl will be high, increasing the overall efficiency and hence useful energy delivered.

Using an equation for the winding resistance (for fixed size coil):

$$Rs=\text{constant}\cdot Ns^2$$

and substituting from the equation:

$$Ns=N\cdot Np=\text{constant}\cdot El/Ipo$$

where the same turns ratio N is assumed for the conventional model coil given above (in terms of Rs, Isp, and Vpl) and the HBI coil, one obtains:

$$Rs=\text{constant}\cdot[El/Ipo]^2$$

Assuming a preferred HBI coil design with stored energy El 2.5 times conventional, i.e. 200 mj versus 80 mj for a state-of-the-art conventional coil, and Ipo 4 times conventional, i.e. 32 amps versus 8 amps for conventional gives:

$$Rs=[2.5/4]^2\cdot 2000\Omega=780$$

which is approximately equal to the 750 Ω derived above to indeed make the arc discharge as efficient as the conventional model glow discharge given above, and hence to provide 2.5 times the spark energy (for 2.5 times the stored energy El assuming other things being equal such as the coil coupling coefficients k).

From this analysis and other beyond the scope of the present disclosure, it can be shown that the preferred strategy for the new (HBI) ignition approach is to use a voltage Vc of approximately 40 volts, or approximately three times that of conventional 12 volt battery voltages, and a peak primary current of approximately 32 amps, i.e. 24 to 40 amps, but preferably "equal to" 32 amps, i.e. 29 to 35 amps, to obtain approximately 2.5 times the spark energy for the same size coil operating from a 12 volt battery with peak current of 8 amps.

There are other features of the invention that are beyond the scope of the present disclosure, which are the result of considerable analysis and discovery. For example, in comparing the preferred design of the present inductive ignition (HBI) to the standard inductive ignition, one finds that for the same size coil one can attain, for the HBI system, 2.5 times the energy El, approximately 0.6 times the primary turns, and one half the secondary turns (achieved in part to a lower turns ratio N made possible by using unclamped 600 volt IGBT switches Si). These factors have not only performance benefits, but significant cost and fabrication benefits in allowing for fewer winding turns, thicker secondary wire, (which for standard ignition can be as fine as 44 AWG which is difficult to handle), and of course one piece open E-type cores.

Another example is that the present design allows for harder driving of the magnetic core at higher magnetic flux density Bpk than conventional coils, which are limited by the reduced permeability at high magnetic flux density B. Typically, since for the present application the effective air-gap is twice as large or greater, closer to core saturation (Bsat) operation can be permitted with the HBI system.

It is emphasized that with regard to the various parameters, dimensions, and designs disclosed herein, that these are to be taken as examples of industry requirements and preferences, and that the inventive principles disclosed herein can be equally applied to a wide variety of coils, including longer length coils of 3 to 6 inches length, or larger diameter coils with even higher stored energy, e.g. 600 to 1000 mj, to obtain the benefits of the (HBI) ignition. Also, closed E-cores with large center gap can be used to obtain low primary inductance of about 0.5 mH, and may be preferred for cases where a biasing magnet is used in the large center leg air-gap (allowing for a larger biasing magnet).

One can also extend the parameter ranges given in the present disclosure to, for example, even higher ignition power by using high voltage (e.g. 900 volt) high current IGBT switches to switch currents Ipo as high as 60 amps, with low inductance Lp of 0.1 mH to 0.4 mH and low turns ratio N of 50 to 80 to obtain peak spark currents Isp in the 0.5 amp to 1.0 amp range, which would be highly resistant to flow and provide even higher power to the air-fuel mixture, which may be of particular interest in racing and other high performance applications.

Since certain changes may be made in the above apparatus and method without departing from the scope of the invention herein disclosed, it is intended that all matter contained in the above description, or shown in the accompanying drawings, shall be interpreted in an illustrative and not limiting sense.

What is claimed is:

1. An inductive ignition system operating at a voltage Vc with a high (voltage) end and low end, the ignition system having one or more ignition coils Ti and associated power switches Si, where i=1,2, . . . n, with each coil Ti having a primary winding of inductance Lp and primary turns Np, and a secondary winding with turns Ns, the coil primary and secondary windings defining a turns ratio N equal to Ns/Np, a first end of the primary winding of each coil Ti being interconnected to a common voltage source point and the other (second) ends to separate switch means Si with the low side of the switch means Si returned to a common point on the low end of said voltage source Vc, and the secondary winding of each coil Ti being connected across a spark gap Gi, said connections forming a set of one or more series circuits, each such circuit including at least said voltage source, each of the primary windings of said coil Ti, and corresponding switch means Si, and wherein upon turning on, or closure, of switch means Si in each such series circuit a primary current Ip builds up within the primary winding of the corresponding coil Ti to a maximum value Ipo, which occurs at switch Si opening, to energize the coil to an energy El equal to $\frac{1}{2} \cdot Lp \cdot Ipo^2$ which is stored in the magnetic core of the coil, the system constructed and arranged to provide:

(a) voltage Vc of X times Vb where X is equal to or greater than 2 and Vb is a car battery voltage of peak nominal operating voltage of 14 volts, (b) a peak current Ipo between 16 and 48 amps, (c) a peak spark current Is between 160 ma and 640 ma, (d) a primary inductance Lp no greater than 1.0 mH, (e) a secondary coil winding resistance Rs less than 2.0 kΩ, (f) a spark current waveform of sufficient peak amplitude and shape so as to have a higher resistance to spark break-up under high flows than standard inductive ignition spark waveforms, the system further constructed and arranged to provide a turns ratio N of sufficiently low ratio, a spark gap Gi of sufficient width, and a dwell time Tdw, during which time switch Si is closed, of sufficiently short duration so that upon switch Si closure the spark gap Gi does not break down, and upon switch Si opening a high voltage of value Vs is produced across the coil secondary winding to electrically breakdown said spark gap Gi and deliver substantially all of said energy El to the spark gap as a high current spark.

2. An inductive ignition system having one or more ignition coils Ti and associated power switches Si, where i=1, 2, . . . n, with each coil Ti having a primary winding of inductance Lp and primary turns Np, and a secondary winding with turns Ns defining a turns ratio N equal to Ns/Np, the system further including a variable control inductor of initial inductance Lsati located between a voltage source powering the ignition and common connections of the primary windings of said coils one or more coils, the variable inductance operating such that upon switch Si closure the voltage across the coil Ti secondary winding is reduced from the value that it would take on without said variable control inductor.

3. An inductive ignition system operating at a voltage Vc between 24 and 80 volts with a peak primary current Ipo of at least 20 amps having one or more ignition coils Ti and associated power switches Si, where i=1,2, . . . n, with each coil Ti having a primary winding of inductance Lp and primary turns Np, and a secondary winding with turns Ns defining a turns ratio N equal to Ns/Np, the system further constructed and arranged to provide a turns ratio N of sufficiently low ratio, a spark gap Gi of sufficient width, and a dwell time Tdw, during which time switch Si is closed, of sufficiently short duration so that upon switch Si closure the spark gap Gi does not break down, and upon switch Si opening a high voltage of value Vs is produced across the coil secondary winding to electrically breakdown said spark gap Gi and produce a peak spark current Is in substantially arc mode.

4. The ignition system as defined in claim 1 wherein the primary turns Np are between 40 and 80 turns.

5. The ignition system as defined in claim 1 wherein said power switches Si are IGBTs of 600 volt rating.

6. The ignition system as defined in claim 1 wherein the core of said coil Ti is of an open E-core form with a center leg with said coil windings being wound concentrically on the center leg of said core.

7. The ignition system as defined in claim 6 wherein the core material is comprised of stacked thin lamination.

8. The ignition system as defined in claim 6 wherein the primary winding is a two layer winding with DC resistance Rp less than 0.4 ohms.

9. The ignition system as defined in claim 6 wherein the coil winding window height h is between ⅜" (0.9 cm) and ½" (1.3 cm) and the length of the primary winding lp is between 0.75" (2 cm) and 1.5" (4 cm).

10. The ignition system as defined in claim 1 wherein the core of said coil Ti is a bobbin type core comprised of a center leg and end flanges with said windings wound concentrically about the center leg of said core.

11. The ignition system as defined in claim 10 wherein the core material is comprised of stacked thin laminations.

12. The ignition system as defined in claim 10 wherein the core material is comprised of pressed powder iron made of two parts divided at some point of the center leg at which dividing point a biasing magnet can be included.

13. The ignition system as defined in claim 12 wherein the relative permeability of the core material is at least 25 for a magnetic field strength of 200 Oersted.

14. The ignition system as defined in claim 1 wherein the coil is essentially cylindrical and comprised of a center magnetic core over which are wound the primary and secondary turns and a thin tubular cylindrical magnetic material (over said windings), the magnetic path including at least one air gap.

15. The ignition system as defined in claim 14 wherein the primary winding is made up of two layers of magnet wire.

16. The ignition system as define in claim 14 wherein the core center leg is of round cross-section which can be sectioned into two parts to include an air gap.

17. The ignition system as defined in claim 16 wherein a biasing magnet is placed in the air gap in the center core section.

18. The ignition system as defined in claim 1 wherein a variable control inductor of initial inductance Lsati is included between said voltage source, of voltage Vc, and said common connections of he primary windings of said coils, and is constructed and arranged so that the inductance Msat of the core of said variable inductor drops as the coil primary current increases.

19. The ignition system as defined in claim 18 wherein said saturable inductor is constructed and arranged to reduce the peak coil Ti output voltage upon power switch Si closure to a value less than will break down the spark gap Gi, and wherein the energy stored in the saturable inductor upon switch Si opening is substantially less than the energy stored in the coil Ti.

20. The ignition system as defined in claim 19 wherein said initial inductance Lsati is about 0.6 times the low primary current coil primary inductance Lp.

21. The ignition system as defined in claim 20 wherein the core of said variable inductor is comprised of high permeability powder iron.

22. The ignition system as defined in claim 1 wherein said voltage source comprises energy storage capacitor means C charged to said voltage Vc.

23. The ignition system as defined in claim 22 and further comprising a current sense resistor Rsense placed between the low voltage side of the capacitor C, defined as the voltage sense point Vsense, and the low side common connection of switches Si, defined as ground, to sense the primary current Ip and control the openings of the switches Si at the predetermined peak primary current Ipo.

24. The ignition system as defined in claim 23 and further comprising an NPN transistor placed with its emitter at the voltage sense point Vsense and its base to ground, and its collector taken to a control circuit to turn off switch Si when the transistor base-emitter junction becomes forward biased as a result of primary current reaching the level Ipo.

25. The ignition system as defined in claim 22 constructed and arranged to operate as an automotive ignition system with a 12 volt battery as the supply voltage and included between the battery and said capacitor C is a DC to DC power converter for raising the battery voltage to the capacitor voltage Vc.

26. The ignition system as defined in claim 25 wherein said power converter is a flyback converter comprised of at least a converter transformer Tcnv, a primary winding switch Scnv, an output diode Dcnv, the power converter providing isolation between the battery and the capacitor C.

27. The ignition system as defined in claim 26 wherein the power converter is constructed and arranged to maintain the output voltage Vc except on closure of ignition power switches Si when it is turned off to provide an anti-latching function to allow the power switches to recover should they become latched.

28. The ignition system as defined in claim 27 wherein the transformer Tcnv has two layered windings, a single layer primary and a single layer secondary.

29. The ignition system as defined in claim 28 wherein the primary winding turns are approximately 12 and the turns ratio of secondary to primary winding is approximately 1.6.

30. The ignition system as defined in claim 28 wherein the core of said transformer Tcnv has a narrow winding window of width "h" approximately equal to 4 mm.

31. The ignition system as defined in claim 28 wherein said output diode Dcnv is an ultra-fast recovery diode and wherein operation of the power converter includes a DC component of current and is of continuous versus discontinuous operating mode in charging its output load capacitor C.

32. The ignition system as defined it claim 25 wherein said power converter is a boost converter with power components comprised of an inductor, a switch, and an output diode.

33. The ignition system as defined in claim 26 wherein the controller for said power converter is a comparator operated as an oscillator which maintains an approximately constant peak converter current Icnv between a regulated input voltage and a higher input voltage below 30 volts, and whose off-time Toff is controlled by a resistor Rc connected to the output voltage Vc which charges a timing capacitor Ct to a prescribed level to define the converter switch off-time.

34. The ignition system as defined in claim 26 wherein said switch Scnv is an N-type FET of 50 to 60 volt rating, and the driver of said switch Scnv comprises a P-type and N-type semiconductor switch whose control elements are connected to the output of a control comparator for turning switch Scnv on and off.

35. The ignition system as defined in claim 29 wherein the primary inductance of said transformer Tcnv is approximately 40 uH.

36. The ignition system as defined in claim 1 and further comprising a lossless snubber constructed and arranged to store the energy Ele associated with the leakage inductance Lpe of said coils Ti, equal to ½•Lpe•Ipo$^2$, in a snubber capacitor of capacitance Csn, and through the action of a snubber switch Ssn which is activated following turn-off of a coil power switch Si to energize a snubber inductor of inductance Lsn which is then de-energized upon switch Ssn opening following fall of snubber capacitor voltage to a level substantially below its peak voltage, and diode means for delivering essentially all the energy stored in the snubber inductor back to the said voltage source Vc.

37. The ignition system as defined in claim 36 wherein said snubber capacitor is connected to the ungrounded ends of each of said power switches Si through diodes Di.

38. The ignition system as defined in claim 37 wherein said snubber switch Ssn is a P-type FET whose gate is connected to a control switch means Scsn whose one end is grounded and other end has a series resistor to the FET gate.

39. The ignition system as defined in claim 38 wherein switches Ssn and Scsn are of about 100 volt rating.

40. The ignition system as defined in claim 36 wherein inductance Lsn of snubber inductor is about 4 mH.

41. The ignition system as defined in claim 36 wherein snubber capacitor stores said energy Ele and the energy in any other inductor (carrying current Ipo) in series with the coil leakage inductance 4, the capacitance value Csn of the snubber capacitor being such that its maximum voltage Vsn is no greater than approximately 80% of the maximum voltage rating of said power switches Si.

42. The ignition system as defined in claim 38 wherein said switches Si are 600 volts rating IGBTs, i.e. 600 volt collector to emitter voltage.

43. The ignition system as defined in claim 36 wherein snubber capacitor has its low voltage connection with the low voltage connection of said power switches Si and is paralleled with a diode clamp to prevent the peak snubber voltage Vsnpk from exceeding the voltage rating of switches Si.

44. The ignition system as defined in claim 41 wherein switch Ssn is a P-type FET with its source connected to the snubber capacitor, with a resistor and protection zener diode across its source and gate, with a series gate resistor, with a control N-type switch Scsn connected between the gate resistor and ground, with the control element of switch Scsn connected to a junction of a resistor pair defining a voltage divider whose one side is grounded and whose other side is connected to the FET source through one or more resistors.

45. The ignition system as defined in claim 44 wherein an ignition input trigger disabling switch has its control element connected to the higher voltage end of said resistor divider pair.

46. The ignition system as defined in claim 1 wherein a voltage Vx of at least 12 volts is obtained from said source voltage Vc to provide turn on voltage for said power switches Si.

47. The ignition system as defined in claim 46 wherein said voltage is obtained from the connection point of the cathode of a zener diode and resistor connected in series and wherein the resistor is connected to the source voltage and the anode of the zener diode is connected to ground.

48. The ignition system as defined in claim 1 comprising an ignition controller circuit to control ignition firing, the controller circuit having trigger input circuits and phase input circuits each containing a timing capacitor and comparator used in conjunction with an octal counter to turn said power switches Si on and off in the required order and for the required time duration Tdw.

49. The ignition system as defined in claim 1 wherein the coils Ti have diodes in series with their secondary winding to prevent current flow during power switch Si closure.

50. The ignition system as defined in claim 1 wherein voltage Vc is at least 36 volts and wherein each ignition coil can be multi-fired to produce more than one high duty cycle ignition spark at a duty cycle above 80% under at least one condition of operation of the ignition due to the rapid charging of the coil Ti primary inductance and long duration of the spark.

51. The ignition system as defined in claim 36 wherein magnetic core of said snubber inductor is made of powder iron.

52. The ignition system as defined in claim 51 wherein the magnetic core of said snubber inductor is an open E-type core with a round center winding post.

53. The ignition system as defined in claim 52 including a non symmetrical bobbin constructed and arranged to have one section within the core winding window on which is wound wire and a second enlarged diameter section that protrudes from the core open end and is usable as a mounting bracket.

54. The ignition system as defined in claim 7 wherein the center leg core cross-section is rectangular with the ratio of long side to the short side being approximately equal to or less than the square root of three, i.e. 1.7.

55. The ignition system as defined in claim 54 wherein the coil body is essentially of round cross-section except for small lamination protrusions.

56. The ignition system as defined in claim 7 wherein the width "d2" of the back end of the lamination is approximately 1.5 times the center leg width "d".

57. The ignition system as defined in claim 7 wherein the center leg core cross-section is square and the coil body is of rectangular cross-section comprising a block coil with the high voltage tower emanating at right angles to the axis of the wire windings near the high voltage end.

58. The ignition system as defined in claim 1 wherein said voltage Vc is about 50 volts, and is used for rapidly charging, within time Tdw less than one millisecond, the primary winding of one or more coils Ti with low inductance primary Lp of about 0.5 mH to a primary current Ipo of 20 to 50 amps by means of power switches Si associated with the primary winding of each coil Ti.

59. The ignition system as defined in claim 1 wherein said coil energizing occurring without false firing of the ignition by using a variable inductor in the power unit which reduces the coil output voltage upon switch closure to approximately one half its value without said inductor.

60. The ignition system as defined in claim 1 including open core coils which have 1 to 2 open core sections on the outer portion of the core structure made possible by the lower primary inductance Lp of the coil of about 0.5mH.

61. The ignition system as defined in claim 1 which uses control circuits of only one current sensor and transistor to set the peak primary current Ipo.

62. The ignition system as defined it claim 1 wherein the system is constructed and arranged such that power switches Si and coils Ti operate with one half or less the heating of conventional inductive ignition systems during the current buildup coil energizing dwell time Tdw for a given stored energy El because of the lower primary inductance Lp, higher voltage Vc, and the resulting very short dwell time Tdw required to attain the peak primary current Ipo.

63. The ignition system as defined in claim 1 wherein the coil secondary windings are connected across spark gaps whose spark current Is, following spark breakdown of the gap, is over 300 ma peak which provides a higher spark power than conventional and arc type, versus glow type, spark discharge during part of the spark, which is less susceptible to segmentation under high flows.

64. The ignition system as defined in claim 1 wherein the coil primary resistance Rp is between 0.1 and 0.3 ohms and the coil secondary resistance Rs is between 300 and 1000 ohms.

65. The ignition system as defined in claim 1 with voltage Vc approximately 40 volts, with low primary inductance Lp of approximately 0.5 millihenry, with high peak coil primary current Ipo of approximately 30 amps, with high coil primary stored energy El of 100 to 500 millijoules, and with flow resistant peak spark currents Is of approximately 400 ma.

66. The ignition system as defined in claim 1 having a high output voltage Vs of about 40 kV or higher and with fast rise time of about 20 microseconds.

67. The ignition system as defined in claim 1 having low coil primary and secondary resistances Rp and Rs less than 0.2 ohm and 800 ohms respectively.

68. The ignition system as defined in claim 1 with magnetic core of the coils Ti having a magnetic path length lm of coil Ti is between 2 and 4 times the coil primary winding length lp and lm is also between 4 and 8 times the center core diameter d'.

69. The ignition system as defined in claim 1 having a spark gap Gi of approximately 0.08" (2 mm).

70. The ignition system as defined in claim 1 wherein said spark gap Gi is located approximately ¼" (0.6 cm) from the spark plug shell end.

71. The ignition system as defined in claim 22 wherein value of said capacitor means C is between approximately 1000 and 2000 microfarads.

72. The ignition system as defined in claim 1 wherein said turns ratio N is between 60 and 120.

73. The ignition system as defined in claim 72 wherein said turns ratio N is approximately 75.

74. The ignition system as defined in claim 1 including both variable inductor and diodes in series with the coil secondary windings wherein said variable inductor allows lower voltage rating of said diodes to be used.

75. The inductive ignition system as defined in claim 1 wherein said voltage Vc is approximately 42 volts.

76. The inductive ignition system as defined in claim 1 wherein said power switches Si are IGBT switches of voltage rating above 600 volts.

77. The inductive ignition system as defined in claim 3 wherein said coil is provided with two windings wound on the center leg of an elongated open E-core with a closed end and an open end and having:

(a) a primary inductance Lp of less than 2 mH;

(b) a peak current Ipo of 20 to 50 amps; and (c) a peak spark current Is greater than 100 ma.

78. The ignition coil as defined in claim 77 wherein the two windings are wound concentrically about the center leg of said magnetic core with the primary comprising a two layer winding.

79. The ignition coil as defined in claim 77 wherein the voltage source used to energize said one or more coils has a voltage of approximately 42 volts.

80. The ignition coil as defined in claim 77 wherein the coil turn ratio N defined by Ns/Np is between 60 and 80.

81. The ignition coil as defined in claim 77 wherein the primary winding wire has two ends which emerge at the closed end of the magnetic E-core and the secondary winding wire has a high voltage end which emerges at the open end of the magnetic E-core.

82. The ignition coil as defined in claim 77 wherein said E-core is formed of magnetic material comprising single piece thin E-laminations stacked to make up the core.

* * * * *